US005642933A

United States Patent [19]

Hitora

[11] Patent Number: 5,642,933

[45] Date of Patent: Jul. 1, 1997

[54] LIGHT SOURCE STRUCTURE FOR SIGNAL INDICATION LAMP

[75] Inventor: Shozo Hitora, Kitakatsuragi-gun, Japan

[73] Assignee: Patlite Corporation, Osaka, Japan

[21] Appl. No.: 527,892

[22] Filed: Sep. 14, 1995

[30] Foreign Application Priority Data

Dec. 29, 1993 [JP] Japan ..... 5-353877

[51] Int. Cl.[6] ..... F21V 13/08

[52] U.S. Cl. ..... 362/243; 362/245; 362/246; 362/252; 362/297; 362/346; 362/348; 362/800

[58] Field of Search ..... 362/240, 241–247, 362/249, 252, 297, 346–348, 800, 61, 80, 307, 293

[56] References Cited

U.S. PATENT DOCUMENTS 4,929,866 5/1990 Murata et al. ..... 362/800
5,045,885 9/1991 Melby ..... 362/348
5,136,483 8/1992 Schoniger et al. ..... 362/800
5,148,146 9/1992 Murphy ..... 340/461
5,567,036 10/1996 Theobald et al. ..... 362/80

*Primary Examiner*—Alan Cariaso
*Attorney, Agent, or Firm*—Koda and Androlia

[57] ABSTRACT

A light source structure for a signal indication lamp including a plurality of LEDs and light reflection members. The light reflection member reflects light emitted from the LEDs and projected as signal light in various colors so as to indicate conditions of machines, danger and the like. The light reflection members are provided with spaces in between and disposed within an effective view angle of the LEDs so that light from the LEDs is reflected by the reflection members toward a specified projection direction and is recognized in the same number as that of the reflection members.

3 Claims, 11 Drawing Sheets

LIGHT SOURCE STRUCTURE FOR SIGNAL INDICATION LAMP

BACKGROUND OF THE INVENTION

1. Filed of the Invention

The present invention relates to a light source structure for a signal indication lamp which is installed in, for example, a workplace, a parking lot and other potentially dangerous places in order to give visual warning signals.

2. Prior Art

Signal indication lamps are used in various places. They are installed on automatic machines, on robots and in production lines for indicating abnormalities of the machines and robots, thus assuring the safety of workers at the production line. They are also used for warning the shortage of material and the clogging of workpieces. When the lamps are used in a parking lot, they can indicate dangerous traffic conditions and that the parking is full.

FIG. 9 shows an example of a conventional signal indication lamp structure that uses LEDs as disclosed in Japanese Patent Application Laid-Open (Kokai) No. 57-93392.

In this prior art, a plurality of LEDs 71*c* are successively connected to one another to define a bar-shaped light source 71. A plurality of bar-shaped light sources 71 are disposed upright along a circle so as to define an indicator section 7. The indicator section 7 is mounted on a mounting table 73 and is covered by a filter case 72. The LEDs 71 are operated by a built-in drive circuit 74. In this prior art lamp as shown in FIG. 8, ninety-eight LEDs are outwardly disposed for projecting signal light toward the circumference thereof.

With the structure describe above, light emitted by the LEDs 71*c* is projected outwardly through the filter case 72; and when the signal indicator lamp is viewed from any viewing angle, the LEDs 71*c* in a plurality of bar-shaped light sources 71 are recognized as dots.

FIG. 10 shows another example of a prior art signal indicator lamp structure. This lamp structure is disclosed in the Japanese Utility Model Application Laid-Open (Kokai) No. 4-108806. In this signal indicator, the light from LEDs is not directly projected toward the circumference but is reflected toward the circumference by reflectors. In particular, the indicator includes a pair of upper and lower plural LEDs 81 disposed to face each other and a cylindrical support which has a bulged portion at the middle thereof. Reflectors 82 are provided on the bulged portion with upper reflectors facing the upper LEDs and the lower reflectors facing the lower LEDs. The LEDs 81 and the reflectors 82 are surrounded by a globe 83 that has diffusion lenses.

In this signal lamp, the light emitted from the LEDs 81 is reflected toward the circumference of the lamp by the reflectors 82 and projected through the globe 83 toward the environment surrounding the lamp. When the signal indicator lamp is viewed from any viewing angle, light sources are recognized as generally plain surfaces that correspond to the reflectors 82.

Other similar types of signal lamps are also known. For example, Japanese Utility Model Application Laid-Open No. 3-12419 discloses a structure in which wired substrates, each having numerous LEDs embedded therein, are disposed in layers. Japanese Utility Model Application Laid-Open No. 3-6675 discloses a structure in which wired substrates, each having numerous LEDs embedded therein, are disposed in the shape of a polygonal column.

In all of the above described conventional light source structures adapted for signal indicator lamps, light emitted from the LEDs may be directly projected toward the environment or simply reflected toward the environment. As a result, as shown in FIG. 9, numerous LEDs are required to enlarge the light source to be recognized. However, in accordance with the conventional structure, the light source is only recognized as an aggregation of numerous dots, which does not provide a pleasing look.

In accordance with the structure shown in FIG. 10, the light from the LED light source is diffused by the globe 83. As a result, the light source is recognized as being rectangular with a generally plain surface, which results in a better look and an improved visibility. However, although there is a structural difference between the type in which the LED light is reflected and the type in which the LED light is directly irradiated, there is no difference with respect to the visibility between these different structures.

Furthermore, the signal indication lamp that uses LEDs as described above has a low power consumption and does not require the maintenance work which may be required for light bulbs that may burn out or may be readily damaged by vibration. However, due to the low brightness of the LED itself, numerous LEDs are required for practical use, and the increased number of LEDs results in increases in power consumption and heat generation. On the other hand, the use of LEDs with a high degree of brightness makes the light indication lamp expensive.

SUMMARY OF THE INVENTION

Accordingly, the object of the present invention is to solve the technical problems in the prior art lamps and to provide a light source structure that uses LED elements as a light source so as to realize a signal indication lamp that uses fewer LEDs but provides a higher visibility.

The above and other objects of the present invention are accomplished by a unique light source structure for a signal indicator lamp wherein reflector members are spaced a predetermined distance from one another and disposed within an effective emission angle of LEDs so that light emitted from the LEDs are reflected by the reflector members at a predetermined angle of projection.

With the structure described above, the same number of LED irradiation surfaces are visible as the number of the reflection surfaces of the reflection members when viewed from a predetermined viewing angle.

Furthermore, in the light source structure for a signal indicator lamp of the present invention, a plurality of LEDs are linearly disposed, and a plurality of reflector members are installed in a stepwise fashion so that the signal light is projected through a diffusion filter that covers a specific direction of projection.

With the structure described above, the same number of LED irradiation surfaces are viewed as the number of the reflection surfaces of the reflection members when viewed from a predetermined viewing angle.

Furthermore, in the light source structure for a signal indication of the present invention, a plurality of LEDs are circularly disposed, and a plurality of reflector members are formed in a stepwise fashion, so that the signal light is projected through a diffusion filter that covers the circumference thereof.

In addition, in the light source structure for a signal indication lamp of the present invention, a plurality of LEDs are disposed in a polygonal fashion, and a plurality of reflector members are also disposed in a polygonal fashion and formed in a stepwise fashion, thus the signal light is projected through a diffusion filter that covers the circumference thereof.

With this structure, the same number of LED irradiation surfaces are viewed as the number of the reflection surfaces of the reflection members when viewed from a predetermined viewing angle.

Still further, in the light source structure for a signal indication lamp of the present invention, each of the plurality of reflector members and an LED supporting member are formed into a unit so that the emission angle of the LED with respect to the reflection member is regulated by the LED supporting member.

With the structure above, the angle between the LED and its associated reflection member can be determined at the time of manufacture, and additional works, such as the angle readjustment, are not required.

DETAILED DESCRIPTION OF THE INVENTION

Figure 1:
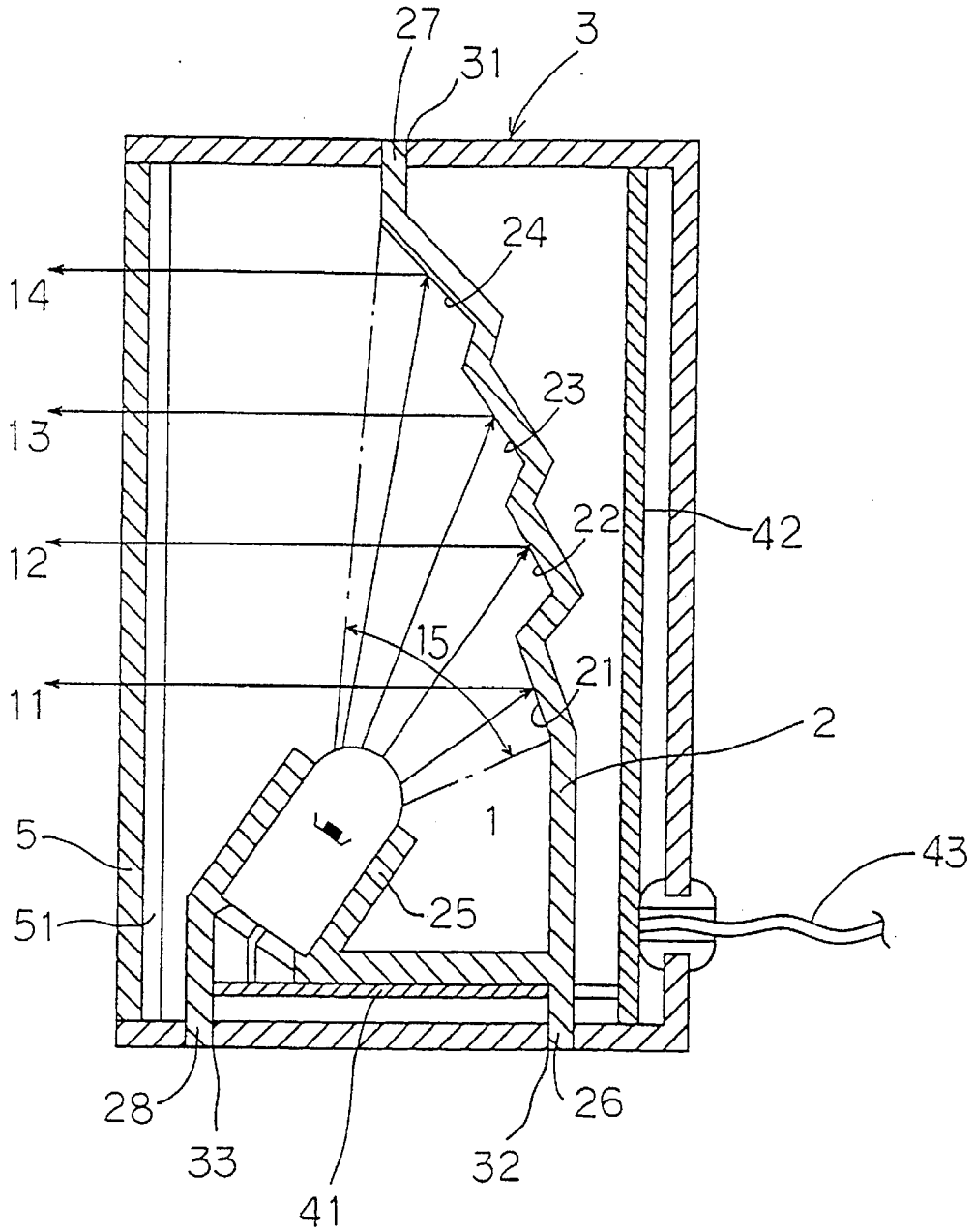
FIG. 1 is a cross-sectional side view of a signal indication lamp in accordance with a first embodiment of the present invention.
Figure 2:
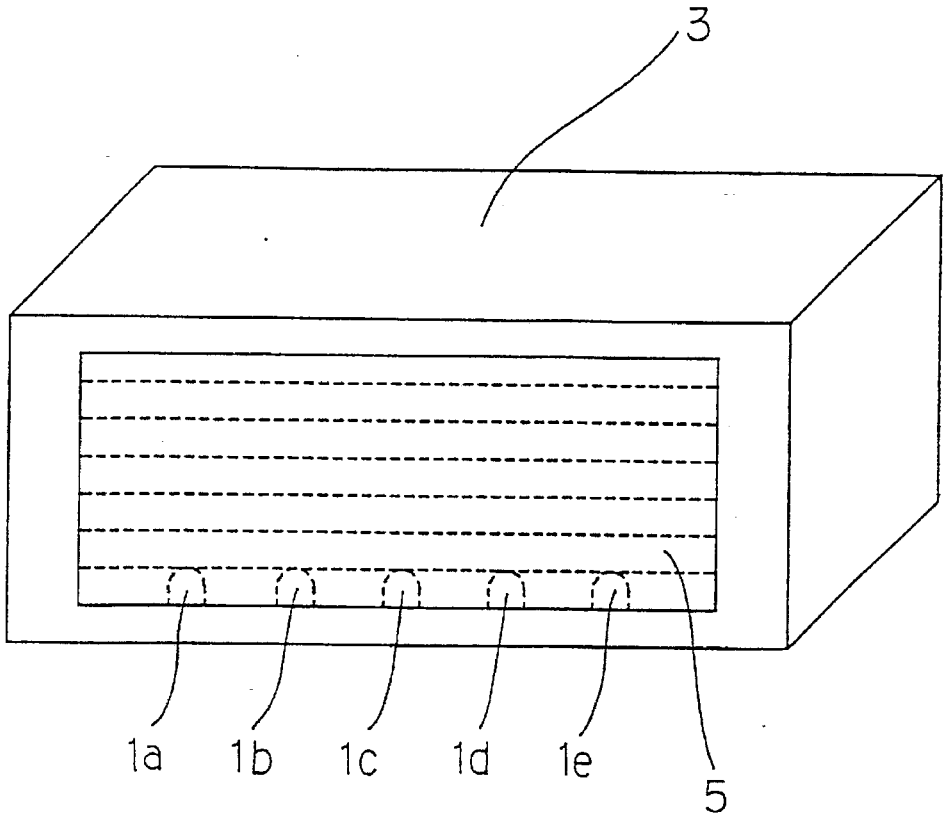
FIG. 2 is a front perspective view of the entire structure of the signal indication lamp of FIG. 1.

FIG. 1 shows the cross-section of the light source structure for a light indication lamp in accordance with a first embodiment of the present invention, and FIG. 2 is a perspective view of its exterior.

The signal indication lamp includes a housing 3 in the shape of a quadrangle box having an opening in its front side which is on the left side in FIG. 1. The housing 3 is provided therein with a plurality of LEDs 1*a*, 1*b*, 1*c*. 1*d* . . . as light sources, a reflection member 2 for reflecting and directing the light emitted from the LEDs, and a control board 42. A diffusion filter 5 is mounted at the front opening of the housing 3 for diffusing the signal light.

The reflection member 2 reflects the light emitted from the LEDs at a specified angle of projection. The reflection member 2 is formed from an injection molded piece or a metal plate such as an aluminum plate. To improve the reflection efficiency, an aluminum evaporation deposition is performed on the reflection member 2. The reflection member 2 shown in FIG. 1 includes: a plurality of reflective surfaces 21, 22, 23, and 24; an LED support 25; and a retainer section for retaining the reflection member to the housing 3. These components are formed into a single unit. The reflective surfaces 21, 22, 23, and 24 are provided so as to reflect the signal lights 11, 12, 13 and 14, respectively, toward the front section of the light indication lamp. The same evaporation deposition described above is performed on the surface thereof.

The reflection surfaces are flat and smooth, and they are defined by the first reflection surface 21 for reflecting the signal light 11, the second reflection surface 22 for reflecting the signal light 12, the third reflection surface 23 for reflecting the signal light 13, and the fourth reflection surface 24 for reflecting the signal light 14. The angle of reflection of each of the reflection surfaces is determined so that the signal light is reflected toward the front of the signal indication lamp. The plurality of reflection surfaces described above are disposed within an effective emission angle of the LED 1, separated a predetermined distance from one another, and disposed with successively different angles in a stepwise fashion as shown in FIG. 1. The effective emission angle varies depending upon the types of LEDs. A typical emission angle of a wide viewing angle LED ranges from 20 degrees to 40 degrees, and such an LED is generally used.

Alternatively, the reflection surface can be a parabolic surface. However, if the reflection surfaces 21, 22, 23 and 24 are formed by parabolic surfaces, the visibility at a viewing angle outside a specified projection angle is substantially poor. On the other hand, if the reflection surfaces are formed by flat surfaces, the light reflected by each one of the reflection surfaces can be viewed even if a viewing angle is slightly diverted in the vertical direction from the specified projection angle. Therefore, for ordinary signal indicator lamps, other than lamps with a restricted projection range, it is preferable to use flat reflection surfaces as shown in the embodiment of the present invention.

The housing 3 is further provided with retaining holes 31, 32 and 33 at the upper side and the bottom side so as to retain the reflection member 2. In other words, the retainer 27 formed at the upper end of the reflection member 2 engages with and is retained by the upper retaining hole 31 of the housing 3, and the retainer 26 formed at the bottom end of the reflection member 2 engages with and is retained by the bottom retaining hole 32 of the housing 3. Furthermore, the retainer 28 is provided at a lower section of the LED support 25 of the reflection member 2 so as to be engaged with and retained by the bottom retaining hole 33 of the housing 3. The reflection member 2 is made so as to be flexed; accordingly, the reflection member 2 is bent and inserted into the housing 3 and then the retainers of the reflection member 2 are engaged with the respective retaining holes of the housing 3. The reflection member 2 is securely held inside the housing 3.

A power line 43 for the signal indication lamp is connected to the control board 42 and to an LED board 41. The control board 42 includes circuits, such as a control circuit and a power circuit. The LED board 41 includes circuits for the plurality of LEDs 1*a*, 1*b*, 1*c*, 1*d* . . .

With the structure described above, the LED light is projected as, for example, red, yellow or orange color signal light for indicating various conditions such as machine breakdown toward a specified direction where such a warning is required to be recognized. The colored signal light may be obtained by means of LED light, by means of colored diffusion filters, or by a combination of these two means. They are selectively used according to the particular requirements. The diffusion filter 5 shown in FIG. 1 has numerous vertically oriented diffusion ribs 51 provided on its internal surface for diffusing the signal light in the horizontal direction. As a result, the signal light is recognized as four bands of light source disposed one on top of the other by the four reflection surfaces 21 through 24 and diffusion filter 5. Instead of the above-described diffusion ribs, other types of rib lenses such as vertically and horizontally oriented lenses or Fresno lenses may be optionally used to enlarge the apparent size of the light source.

Figure 3:
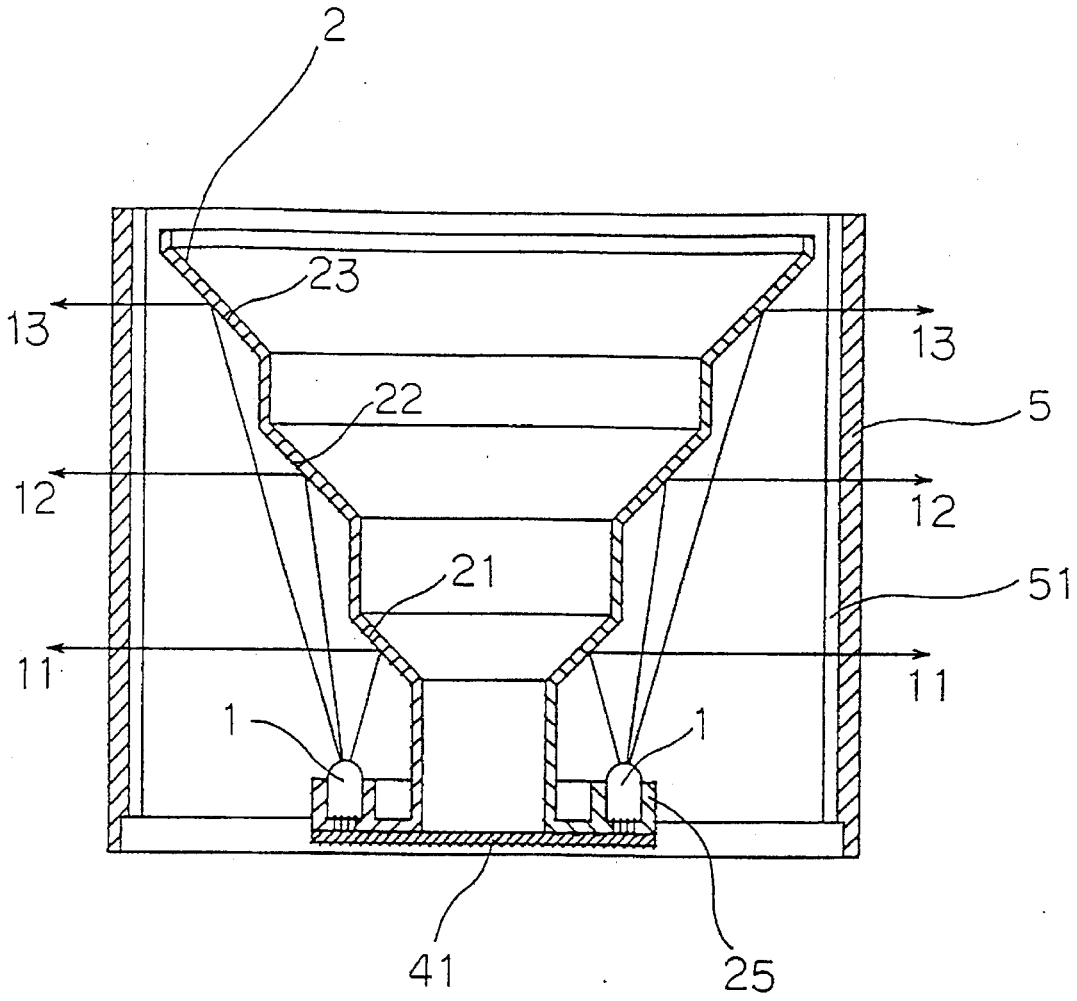
FIG. 3 is a cross-sectional view of a signal indication lamp in accordance with a second embodiment of the present invention.
Figure 5:
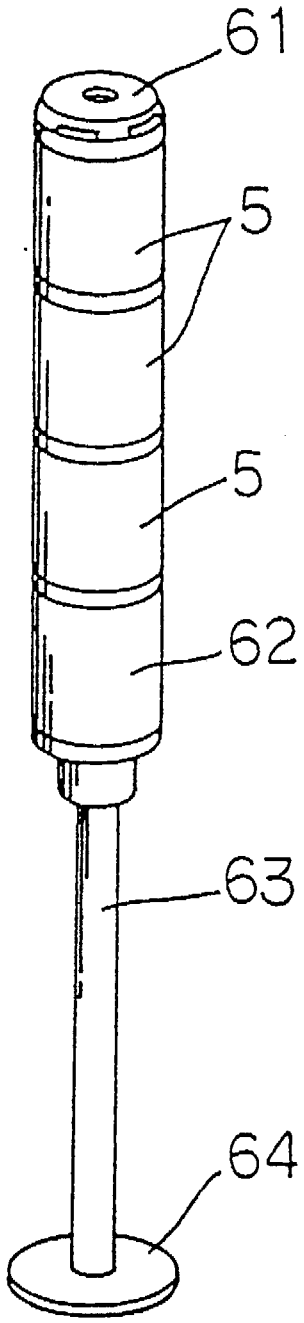
FIG. 5 is a perspective view of the entire structure of the signal indication lamp in FIG. 3.
Figure 6:
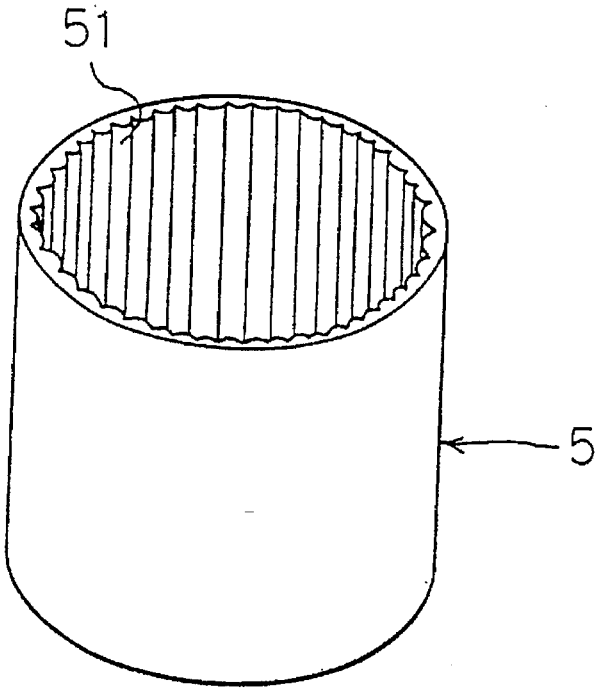
FIG. 6 is a perspective view of the diffusion filter used in the signal indication lamp of FIG. 3.

FIG. 3 shows the cross-section of a light source structure for a light indication lamp in accordance with a second embodiment of the present invention, FIG. 5 is a perspective view of the exterior of the light indication lamp, and FIG. 6 is a perspective view of the diffusion filter 5 used in this second embodiment. The signal indication lamp according to this embodiment has a column shaped light source structure and a cylindrical diffusion filter.

Figure 4:
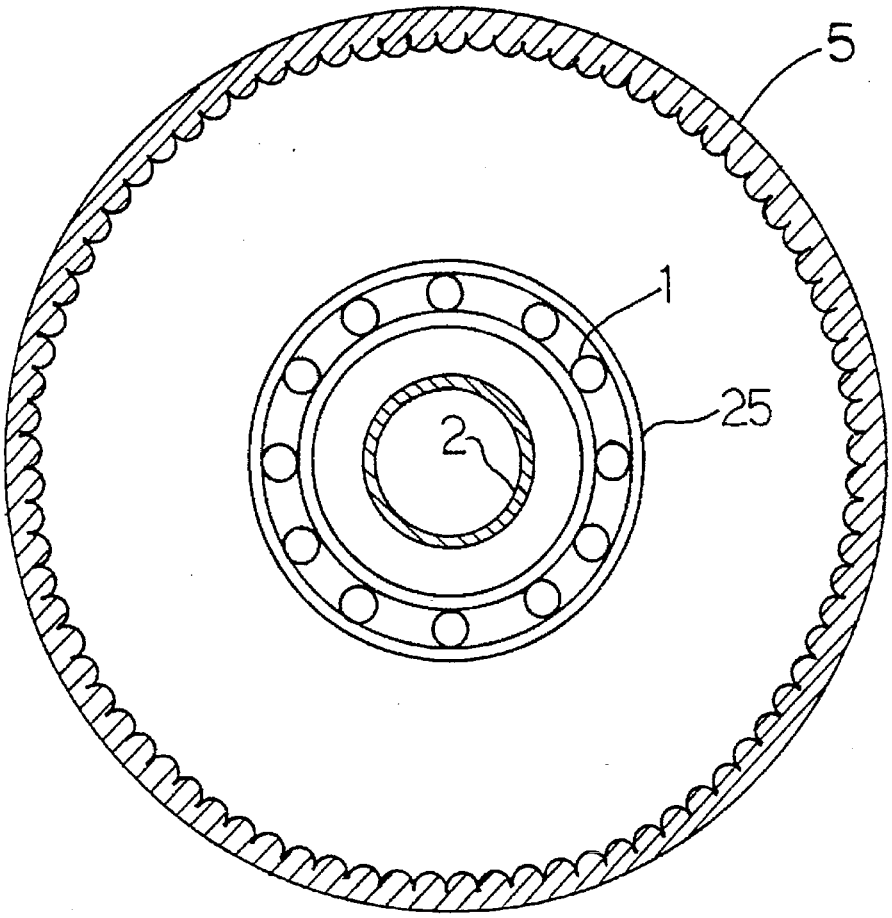
FIG. 4 shows a horizontal cross-section of the lamp particularly showing the circularly disposed LEDs.

In FIG. 3, the reference numeral 1 denotes LEDs, the reference numeral 2 denotes a reflection member, and the reference numeral 5 denotes a diffusion filter. The signal indication lamp light source structure is formed by the plurality of LEDs 1 that are circularly disposed, as shown in FIG. 4, in an upright position, the plurality of reflection members 2 that are disposed in a stepwise fashion within the upper effective viewing angle, and the diffusion filter 5 that encircles the LEDs 1 and the reflection members 2. The diffusion filter 5 has vertically oriented lens-shaped diffusion ribs 51 on the interior wall thereof, and the indication light is projected toward the entire circumference.

The reflection member 2 of this light source structure is formed generally in the shape of a funnel and includes a plurality of reflection surfaces 21, 22, and 23 for reflecting the signal light 11, 12 and 13, respectively, toward the circumference of the signal indication lamp, and an LED support 25 that are formed in a single unit. Evaporation deposition is performed on the surface of the reflection member 2 in order to improve the reflection efficiency. The reflection surfaces comprise the first reflection surface 21 for reflecting the signal light 11, the second reflection surface 22 for reflecting the signal light 12 and the third reflection surface 23 for reflecting the signal light 13. Each of these reflection surfaces is a conically curved surface. The reflection angle is determined so that the signal light is reflected toward the circumference of the signal indication lamp and generally in the horizontal direction. The plurality of reflection surfaces described above are disposed within the effective emission angle of the LEDs 1.

The overall structure of the signal indication lamp of this embodiment is shown in FIG. 5. As seen from FIG. 5, the lamp of this embodiment comprises two sections: an indication section and a mounting section. The indication section comprises three of the above-described light source structures disposed one on top of the other in layers on a main housing 62 so that each of the light source structures is encircled by the diffusion filter 5. In addition, a head cover 61 is provided at the top of the layers. On the other hand, the mounting section comprises a pole 63 and a mounting plate 64. The bottom of the main housing 62 is connected to the pole 63.

In this manner, the signal indication lamp of this embodiment is obtained by the light sources which are disposed one on top of the other to form a layered type signal indication lamp. It should be noted that the structures according to the first embodiment can also be in a layered structure.

The diffusion filter 5 which is used in the signal indication lamp of the second embodiment has diffusion ribs 51 as shown in FIG. 6. The signal light 11, 12 and 13 are reflected by the respective reflection surfaces toward the circumference and then diffused by the diffusion ribs 51. As a result, three bands of light source corresponding to the respective reflection surfaces are recognized. Accordingly, though a light source formed by LEDs may provide dotted light, due to the structure in accordance with this embodiment, the light source formed by LEDs is perceived as a large flat illuminating surface that would be obtained by ordinary light bulbs. Thus, the visibility is substantially improved.

Alternatively, in the above-described structure, the plurality of LEDs may be disposed in the shape of a polygon (not a circle as in the first embodiment), such as for example, the configuration in FIG. 1 rectangle, with the plurality of reflection members disposed in a stepwise fashion, so that the light is projected through a diffusion filter that surrounds the light source. By this structure, the same function and effects as described above are obtained. In this case, the diffusion filter and the housing may have a cylindrical shape; however, by forming the diffusion filter and the housing in the same polygonal shape as that of the LEDs' configuration, it is possible to obtain better diffusion of the signal light. Further, the same result can be obtained by a combination of the generally conically shaped reflection members shown in FIG. 3 and the polygonally shaped diffusion filter.

Figure 7A:
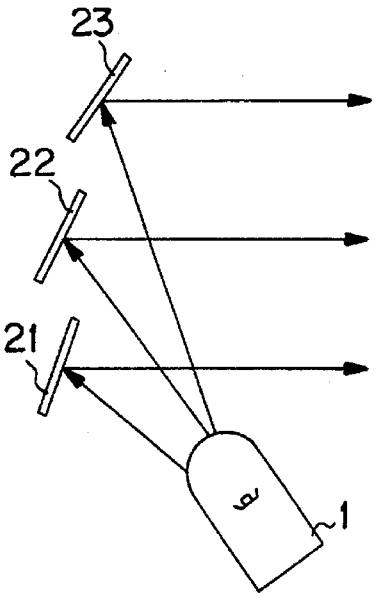
FIG. 7 shows light distributions of signal light in accordance with the embodiments of the present invention.
Figure 7B:
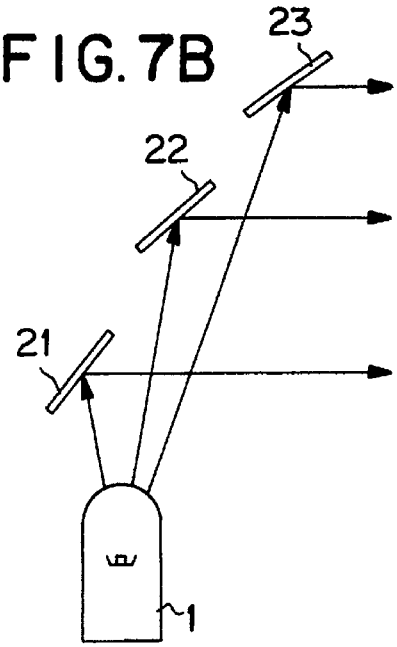
Figure 7C:
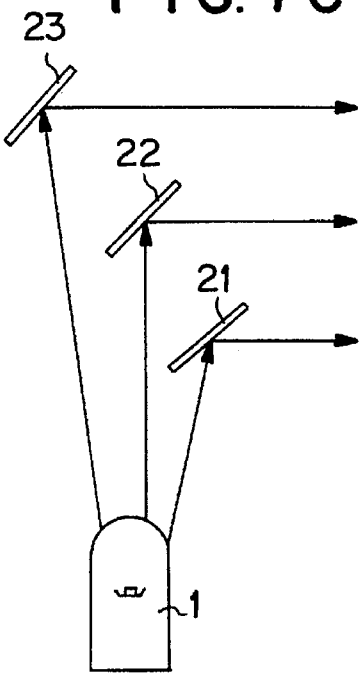

FIGS. 7(*a*) through 7(*c*) show the distributions of the LED lights which are all within the scope of the present invention.

First, FIG. 7(*a*) shows the structure described above with reference to the first embodiment. According to this structure, the LED 1 is obliquely disposed so that the corresponding plurality of reflection members 21, 22 and 23 can be disposed generally in the vertical direction. As a result, the lateral width of the entire light source structure can be narrow, resulting in a thin product. Moreover, each of the reflecting members can be made wide in its vertical direction. As a consequence, this structure provides the signal light with a wide viewable angle in the vertical direction.

FIG. 7(*b*) shows the structure described above with reference to the second embodiment. According to this structure, the LED 1 is vertically disposed, and the reflection members 21, 22 and 23 are successively disposed in a stepwise fashion. As a result, the vertical separation between adjacent reflection members can be narrowed, and therefore the product can be minimized in its vertical direction. In addition, the vertically disposed LED facilitates the manufacture.

FIG. 7(*c*) shows a structure in which the LED 1 is vertically disposed, and the reflection members 21, 22 and 23 are disposed in a stepwise fashion and generally in parallel with each other. Light emitted from the LED 1 passes by the rear side of the reflection member 21, reaches the reflection member 22 and is reflected toward a specified projection direction. The light further passes by the rear side of the reflection member 22 and reaches the reflection member 23 and reflected toward a specified projection direction. The structure of this embodiment provides an effective means to broaden the vertical width of each reflection surface.

The embodiments described above show three typical light projection structures. However, the placement angle between the LED device and the reflection members may be changed according to the particular usage requirements.

Figure 8A:
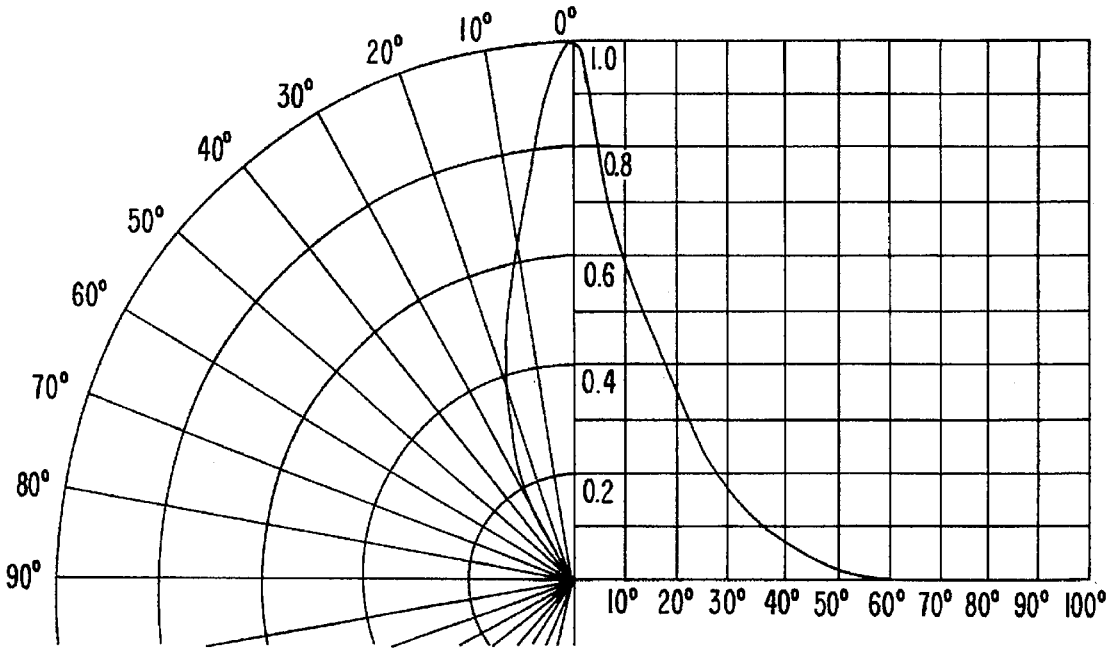
FIG. 8 shows radiation characteristics of LEDs.
Figure 8B:
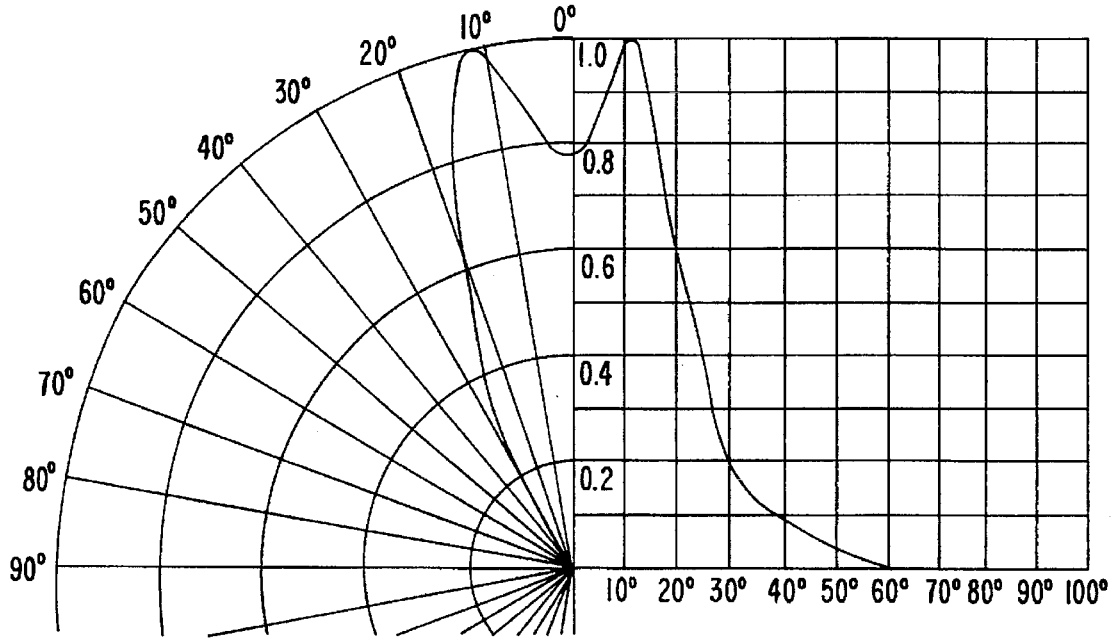
Figure 9:
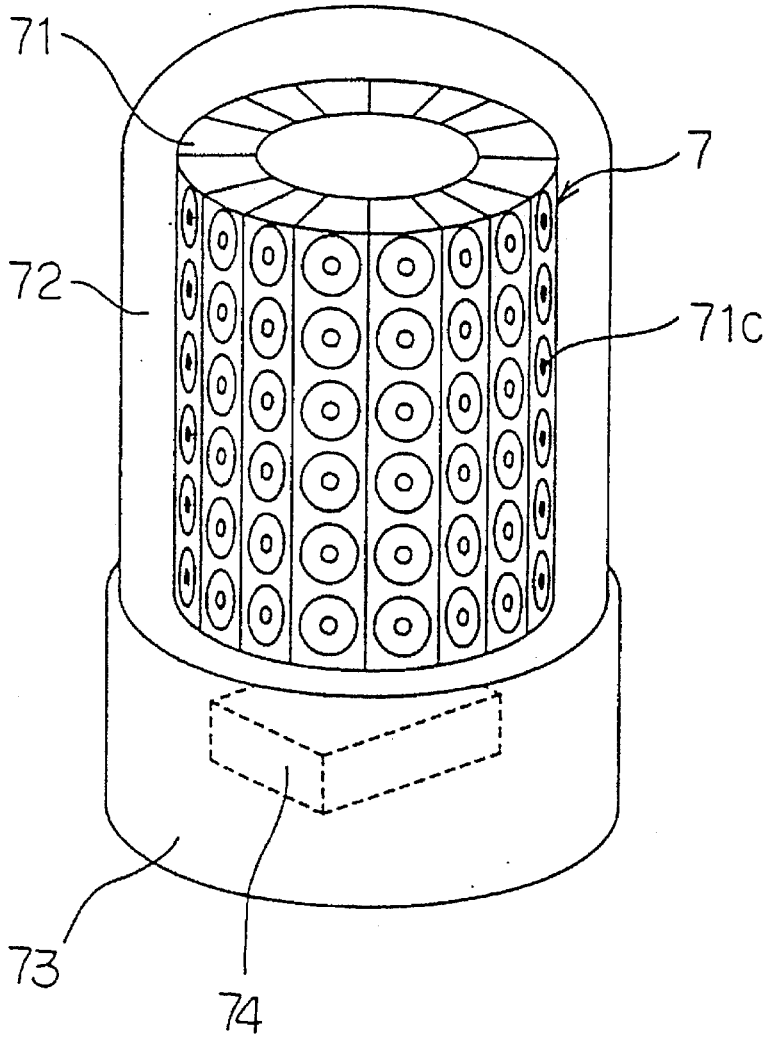
FIG. 9 PRIOR ART
FIG. 9 is a perspective view of the exterior of a conventional signal indication lamp.
Figure 10:
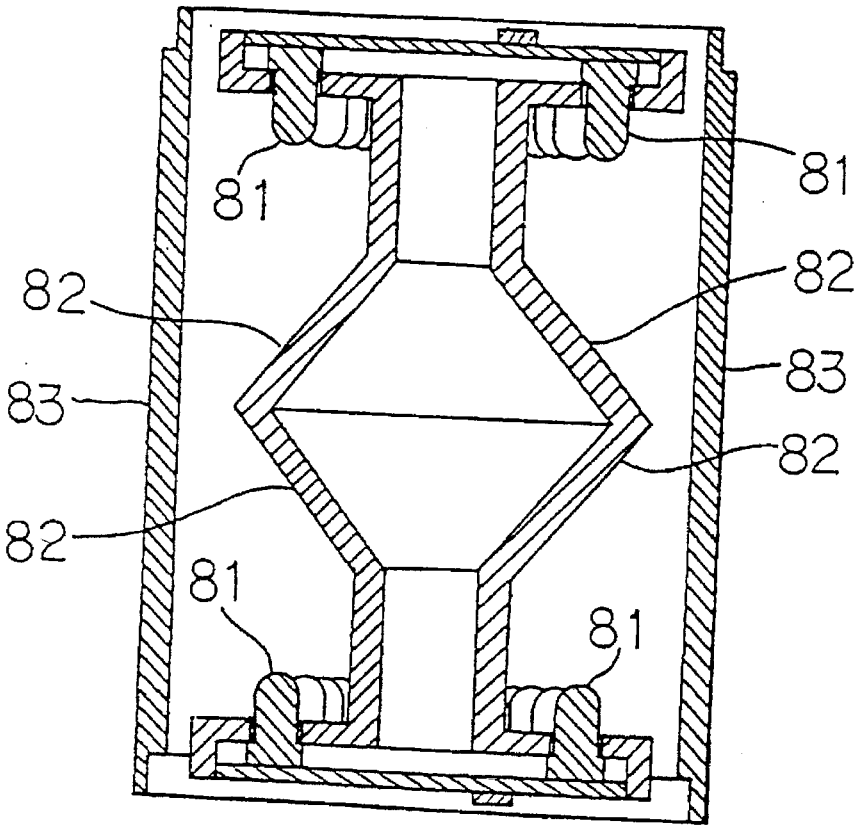
FIG. 10 PRIOR ART
FIG. 10 is a perspective view of the exterior of another conventional signal indication lamp.
Figure 11:
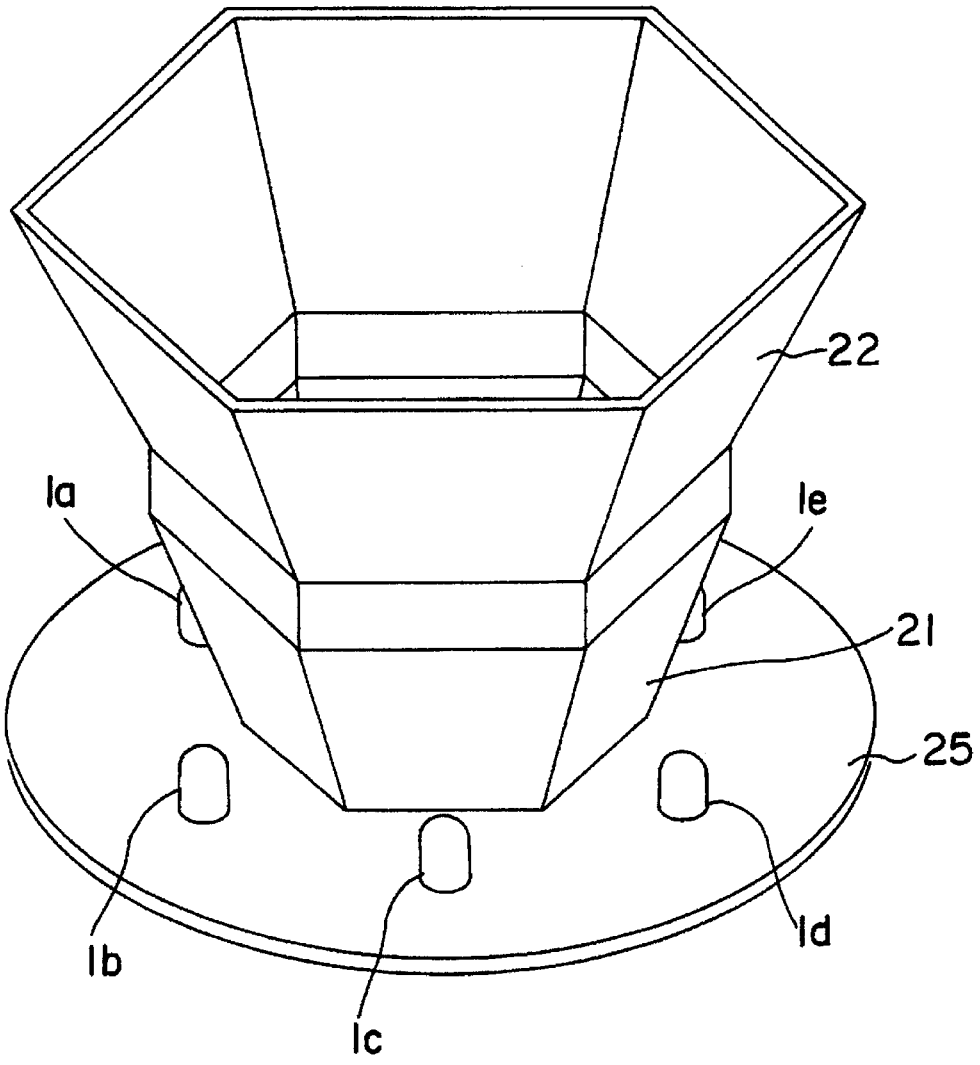
FIG. 11 is a perspective view of another embodiment of the present invention.

FIG. 8(*a*) and 8(*b*) are graphs showing the emission characteristics of LED elements. The LED elements shown in FIGS. 8(*a*) and 8(*b*) are both "wide emission angle LEDs". Generally, the emission angle of an LED is often represented by a radius angle of an area having half the highest brightness of the LED. An ordinary LED element generally has an emission angle ranging from 10 degrees to 30 degrees, and the "wide emission angle LED" element has an emission angle ranging from 20 degrees to 40 degrees.

In recent years, LED elements with higher brightness have been developed. As a result, light emitted from an LED element is still used practically for signal indication even in an area outside the ordinary LED emission angle, that is outside a range that has half the highest brightness. The effective emission angle of LED elements is relatively widely set from about 10 degrees to about 20 degrees, in order to accommodate various types of LED elements.

The horizontal axis of the emission characteristics graphs represents radial angles with respect to the front surface of the LED element, and the vertical axis represents brightness ratios with respect to the highest brightness. For example, the value of 0.4 along the vertical axis indicates a radius angle within which 40% of the highest brightness is obtained.

The LED emission angle, that is a radial angle of an area having half the highest brightness, of the exemplary LED shown in FIG. 8(*a*) is about 15 degrees. Since the LED has an area which has half the highest brightness at 15 degrees on each of the right and left sides about the front center, the viewable angle of the LED is 30 degrees. The effective radiation angle that may be used for signal indication is from about 40 to about 50 degrees. The range of this angle may vary depending upon the highest brightness, the color of emission light of LEDs that are used and other factors.

The exemplary LED shown in FIG. 8(*b*) has an area having half the highest brightness at 10 degrees on each of the right and left sides about the front center. The viewable angle of the LED is about 50 degrees, and the effective radiation angle that may be used for signal indication is up to 60-plus degrees. The LEDs having such emission characteristics have a wide emission range of high brightness. Therefore, they are preferably adapted in combination with a plurality of reflection members to achieve the light source structure in accordance with the present invention.

By giving consideration to conditions such as the relative position and angle with respect to the reflection members and the size of the reflection member, LEDs having other emission characteristics may also be used for the light source structure in accordance with the present invention.

The present invention is described above with reference to the embodiments. However, the present invention is not limited to the described embodiments. For example, a plurality of reflection members may be formed in a unit. In another embodiment, a plurality of reflection members may be independently formed so that they are connected to one another by a coupling means to form a single unit and then connected to an LED support, as long as the relative position between the reflecting members and the LED is appropriately determined. In the embodiment detailed above, the housing is in the shape of a rectangular box. However, a signal indication lamp may have, for example, a circular surface or a triangular surface, because the light source structure can be accommodated in any configuration of the housing.

Other modifications in the design and applications of the invention to products similar to the ones described herein are possible without departing from the scope of the subject matter of the present invention.

As described above in detail, according to the present invention, the light source of a signal indication lamp, which uses LEDs, is recognized as an enlarged and strong light source. Further, the number of LEDs can be substantially reduced as compared with that of the typical conventional signal indication lamp. As a result, the invention can largely contribute to the reduction of cost of signal indication lamps. As a consequence, there is an increased number of applications where light bulb type signal indication lamps can be replaced with the LED-type signal indication lamps of this invention. Furthermore, the present invention provides substantial benefits in terms of actual application. For example, highly visible signal indication lamps with low power consumption and low maintenance requirement can be provided at low cost.

Furthermore, because the reflection member and the LED support are formed in a single unit, the management of the angle between the LED and the reflection member required for the signal indication lamp is substantially facilitated, and the angle adjustment step in the manufacturing process is not required any longer.

When the light source structure in accordance with the present invention is assembled, if the LEDs are disposed in the upper area of the lamp and the reflection members are disposed in the lower area thereof, then the LED light can be directly recognized when the signal indication lamp is obliquely viewed from a lower position. This provides a wider viewable angle. On the other hand, if the LEDs are disposed in the lower area of the lamp and the reflection members are disposed in the upper area thereof during assembly, an incident of external light according to a false lighting can be prevented. Therefore, a clear difference between the lit condition and the unlit condition of the LEDs can be easily recognized. As a result, the present invention improves the visibility of a signal indication lamp.

I claim:

1. A light source structure for a signal indication lamp comprising light emitting diodes and a plurality of reflector members for reflecting a light from said light emitting diodes to a predetermined angle of projection said reflector members being spacedly provided at a predetermined distance from one another and disposed within an effective emission angle of said light emitting diodes, and wherein a plurality of said light emitting diodes are circularly disposed, and a plurality of said reflector members are formed in a stepwise fashion so that signal light is projected through a diffusion filter that covers a circumference of said reflector members.

2. A light source structure for a signal indication lamp comprising light emitting diodes and a plurality of reflector members for reflecting a light from said light emitting diodes to a predetermined angle of projection, said reflector members being spacedly provided at a predetermined distance from one another and disposed within an effective emission angle of said light emitting diodes, and wherein a plurality of said light emitting diodes are disposed in a polygonal fashion, and a plurality of said reflector members are disposed in a polygonal fashion and formed in a stepwise fashion so that a signal light is projected through a diffusion filter that covers a circumference of said reflector members.

3. A light source structure for a signal indication lamp according to any one of claim 1 and claim 2, wherein each of said plurality of reflector members has an integrally formed an light emitting diode supporting member for regulating an emission angle of said light emitting diode.

* * * * *